US011628580B2

(12) United States Patent
Park et al.

(10) Patent No.: US 11,628,580 B2
(45) Date of Patent: Apr. 18, 2023

(54) DUAL DOUBLE-EDGE RAZOR

(71) Applicant: DORCO CO., LTD., Seoul (KR)

(72) Inventors: Young Ho Park, Seoul (KR); Jae Joon Lee, Seoul (KR); Sung Hee Son, Seoul (KR); Shin Hwan Park, Seoul (KR)

(73) Assignee: DORCO CO., LTD., Seoul (KR)

( * ) Notice: Subject to any disclaimer, the term of this patent is extended or adjusted under 35 U.S.C. 154(b) by 174 days.

(21) Appl. No.: 16/465,899

(22) PCT Filed: Nov. 13, 2017

(86) PCT No.: PCT/KR2017/012789
§ 371 (c)(1),
(2) Date: May 31, 2019

(87) PCT Pub. No.: WO2018/101644
PCT Pub. Date: Jun. 7, 2018

(65) Prior Publication Data

US 2019/0299439 A1 Oct. 3, 2019

(30) Foreign Application Priority Data

Dec. 2, 2016 (KR) ..... 10-2016-0163134

(51) Int. Cl.
*B26B 21/18* (2006.01)
*B26B 21/22* (2006.01)
(Continued)

(52) U.S. Cl.
CPC ..... *B26B 21/18* (2013.01); *B26B 21/222* (2013.01); *B26B 21/4037* (2013.01); *B26B 21/54* (2013.01)

(58) Field of Classification Search
CPC ... B26B 21/18; B26B 21/222; B26B 21/4037; B26B 21/54
(Continued)

(56) References Cited

U.S. PATENT DOCUMENTS 1,065,109 A * 6/1913 Bunnell ..... B26B 21/16 30/51
1,934,422 A 11/1933 Gray
(Continued)

FOREIGN PATENT DOCUMENTS

CN 2086192 10/1991
CN 2551419 5/2003
(Continued)

OTHER PUBLICATIONS

State Intellectual Property Office of the People's Republic of China Application Serial No. 201780004988.0, Office Action dated Apr. 26, 2019, 3 pages.
(Continued)

*Primary Examiner* — Jonathan G Riley
(74) *Attorney, Agent, or Firm* — Lee, Hong, Degerman, Kang & Waimey PC

(57) ABSTRACT

The present invention relates to a razor including a handle, a frame coupled to the handle, a spacer, a top cap, a first blade secured between the frame and the spacer, and a second blade secured between the spacer and the top cap, wherein the first blade is supported by a portion of a top surface of the frame and a portion of a bottom surface of the spacer such that a first profile of the first blade is convexly curved upward, and wherein the second blade is supported by a portion of a top surface of the spacer and a portion of a bottom surface of the top cap such that a second profile of the second blade comprises a curved central region that is convexly curved upward and a pair of curved side regions that are concavely curved downward on opposite sides of the central region.

15 Claims, 10 Drawing Sheets

(51) Int. Cl.
*B26B 21/40* (2006.01)
*B26B 21/54* (2006.01)

(58) Field of Classification Search
USPC ..... 30/53, 54, 55
See application file for complete search history.

(56) References Cited

U.S. PATENT DOCUMENTS 1,996,503 A * 4/1935 Darby ..... B26B 21/32 30/59
2,030,658 A * 2/1936 Schodlbauer ..... B26B 21/30 30/58
2,052,395 A * 8/1936 Geissler ..... B26B 21/32 30/60
2,141,339 A * 12/1938 Bauerle ..... B26B 21/18 30/84
2,319,980 A 5/1943 Jardins
2,395,272 A * 2/1946 Hellmann ..... B26B 21/32 30/60
2,505,493 A * 4/1950 Herrmann ..... B26B 21/22 30/50
2,537,528 A * 1/1951 Hellmann ..... B26B 21/18 30/70
2,657,460 A * 11/1953 Cerino ..... B26B 21/54 30/346.61
2,804,685 A 9/1957 Peters, Jr.
3,079,685 A * 3/1963 Scully ..... B26B 21/185 30/72
3,154,852 A * 11/1964 Westlake, Jr. ..... B26B 21/32 30/51
3,262,206 A * 7/1966 Tomek ..... B26B 21/54 30/346
3,608,193 A * 9/1971 Jerusalmi ..... B26B 21/32 30/58
3,650,027 A * 3/1972 Stephenson ..... B26B 21/32 30/58
3,748,735 A * 7/1973 Whittington ..... B26B 21/18 30/70
3,777,396 A * 12/1973 Simonetti ..... B26B 21/22 30/47
3,842,502 A * 10/1974 Hagan ..... B26B 21/54 30/346.58
3,934,338 A 1/1976 Braginetz
3,972,115 A * 8/1976 Ross ..... B26B 21/32 30/59
4,037,321 A * 7/1977 Iten ..... B26B 21/18 30/47
4,125,939 A 11/1978 Brothers
4,184,247 A * 1/1980 Poisson ..... B26B 21/30 30/59
4,189,832 A * 2/1980 Harper ..... B26B 21/20 30/34.2
5,070,614 A * 12/1991 Hardin ..... B26B 21/28 30/527
5,687,485 A 11/1997 Shurtleff et al.
5,761,814 A 6/1998 Anderson et al.
5,956,848 A 9/1999 Tseng et al.
5,956,851 A 9/1999 Apprille et al.
6,041,926 A 3/2000 Petricca et al.
6,052,903 A 4/2000 Metcalf et al.
6,185,822 B1 2/2001 Tseng et al.
6,212,777 B1 4/2001 Gilder et al.
6,442,839 B1 9/2002 Tseng et al.
6,516,518 B1 2/2003 Garraway et al.
6,612,040 B2 9/2003 Gilder
6,684,513 B1 2/2004 Clipstone et al.
9,505,142 B2 11/2016 Nordstrom
2015/0352737 A1* 12/2015 Hickam ..... B26B 21/18 30/70
2017/0113363 A1* 4/2017 Lopez ..... B26B 21/521
2017/0274541 A1* 9/2017 Gilor ..... B26B 21/443

FOREIGN PATENT DOCUMENTS

CN 205201582 5/2016
DE 3011537 10/1981
KR 1020050085976 8/2005

OTHER PUBLICATIONS

PCT International Application No. PCT/KR2017/012789, International Search Report dated Feb. 13, 2018, 8 pages.
European Patent Office Application Serial No. 17876651.5, Search Report dated Nov. 12, 2019, 8 pages.

* cited by examiner

【FIG. 1】
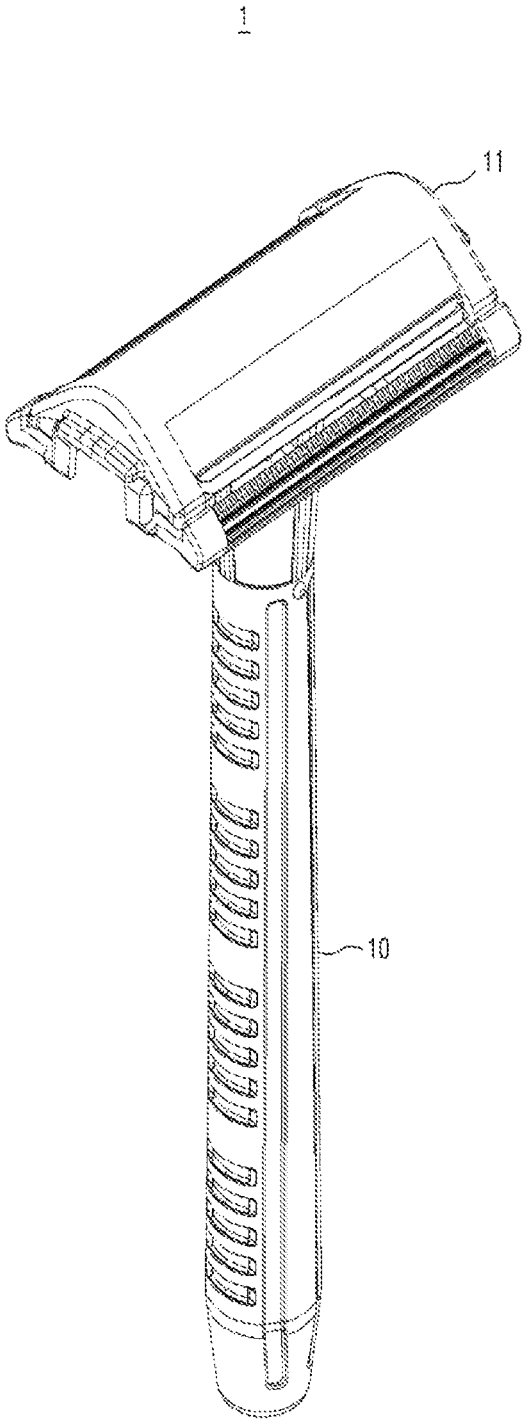

【FIG. 2】
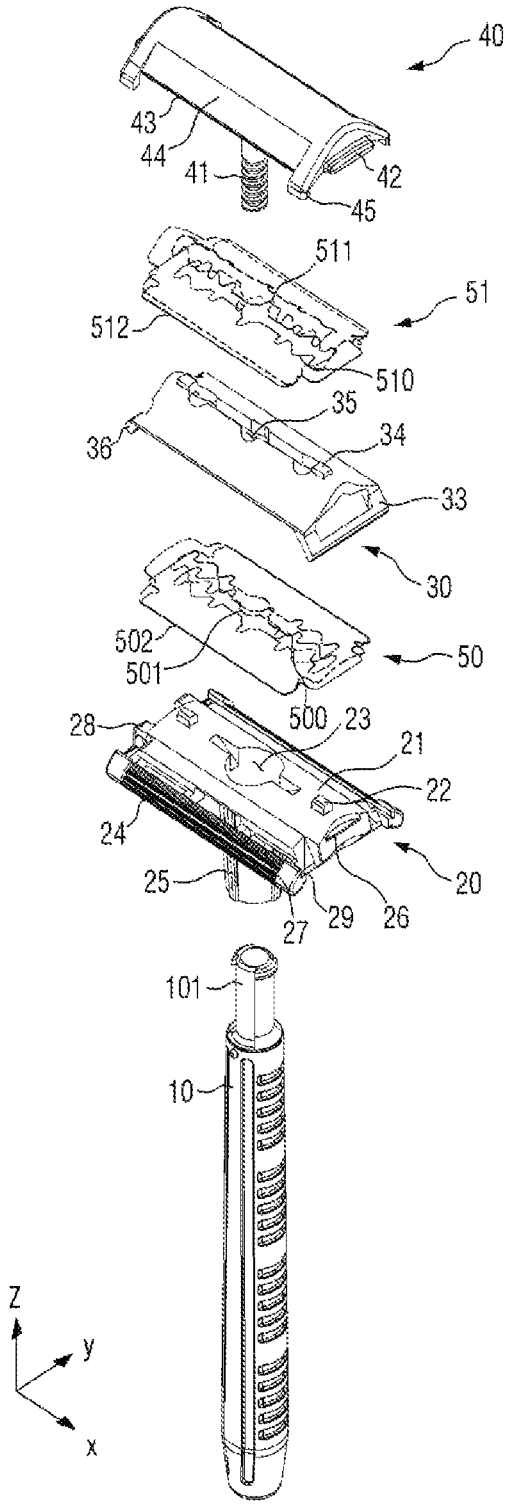

【FIG. 3】
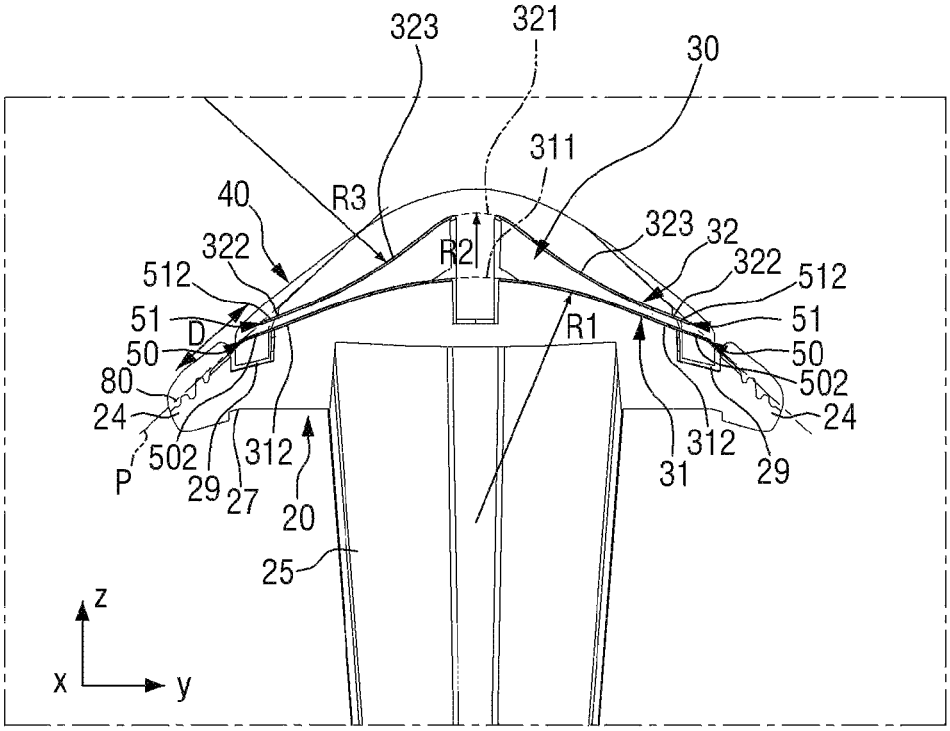
【FIG. 4A】
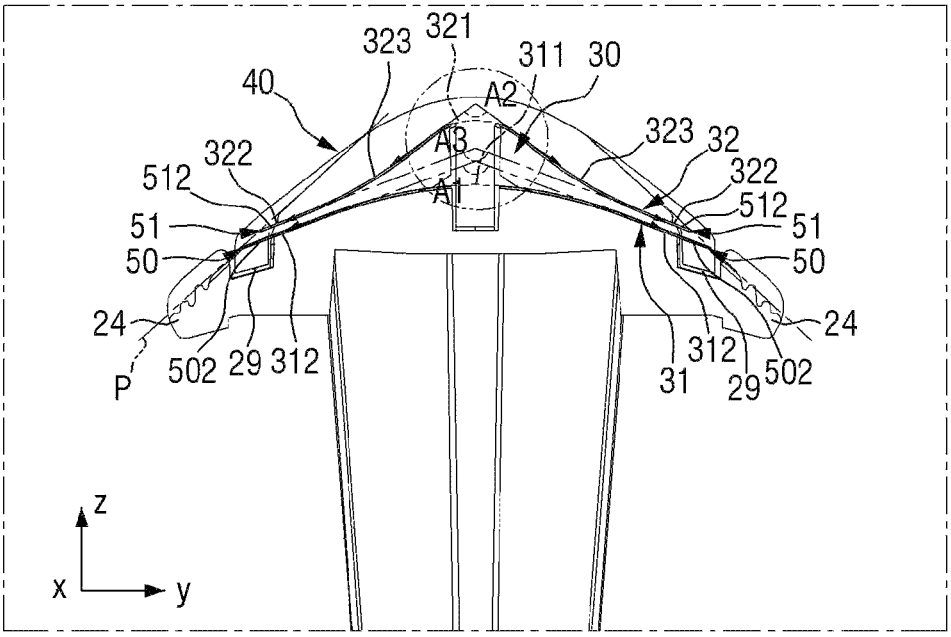

【FIG. 4B】
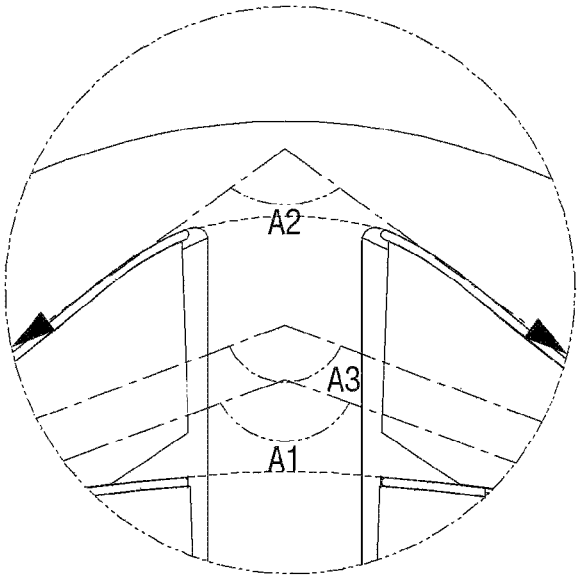
【FIG. 5】
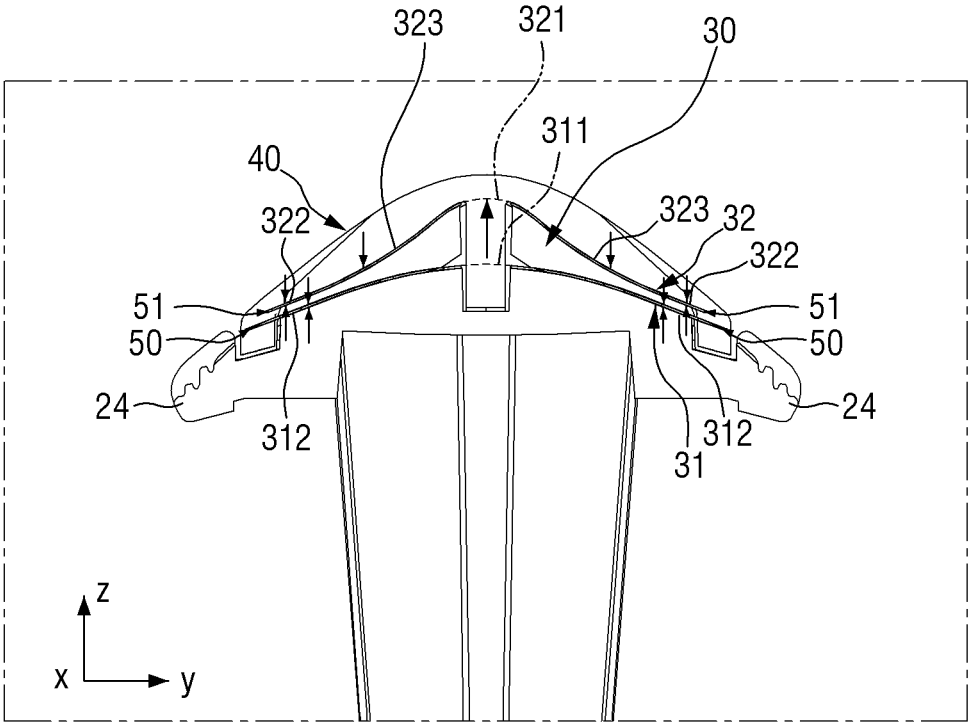

【FIG. 6】
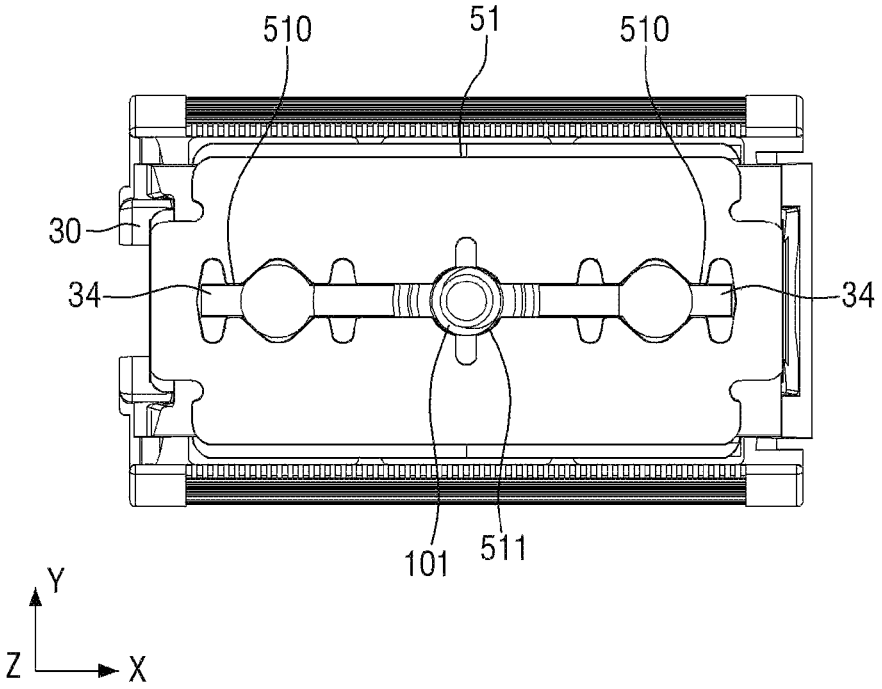
【FIG. 7】
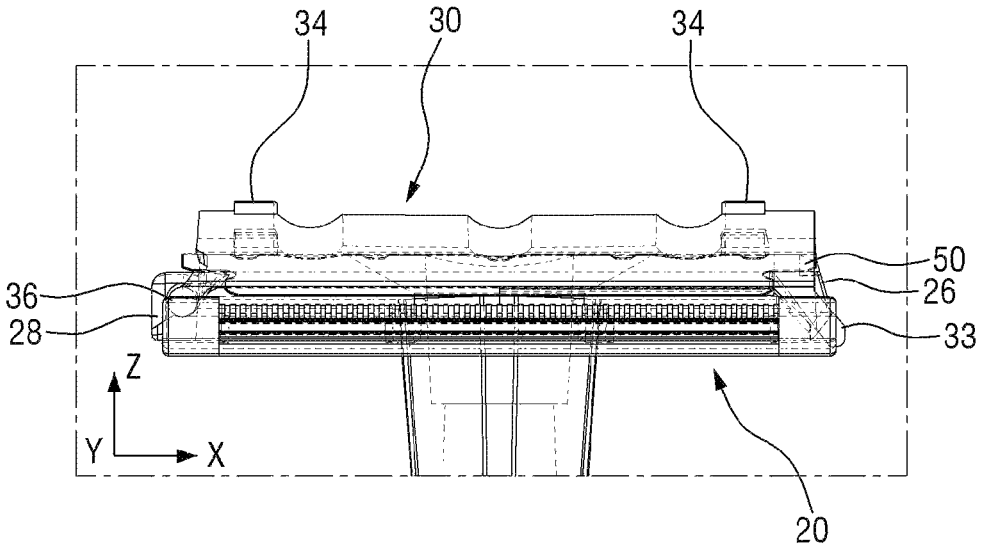

【FIG. 8A】
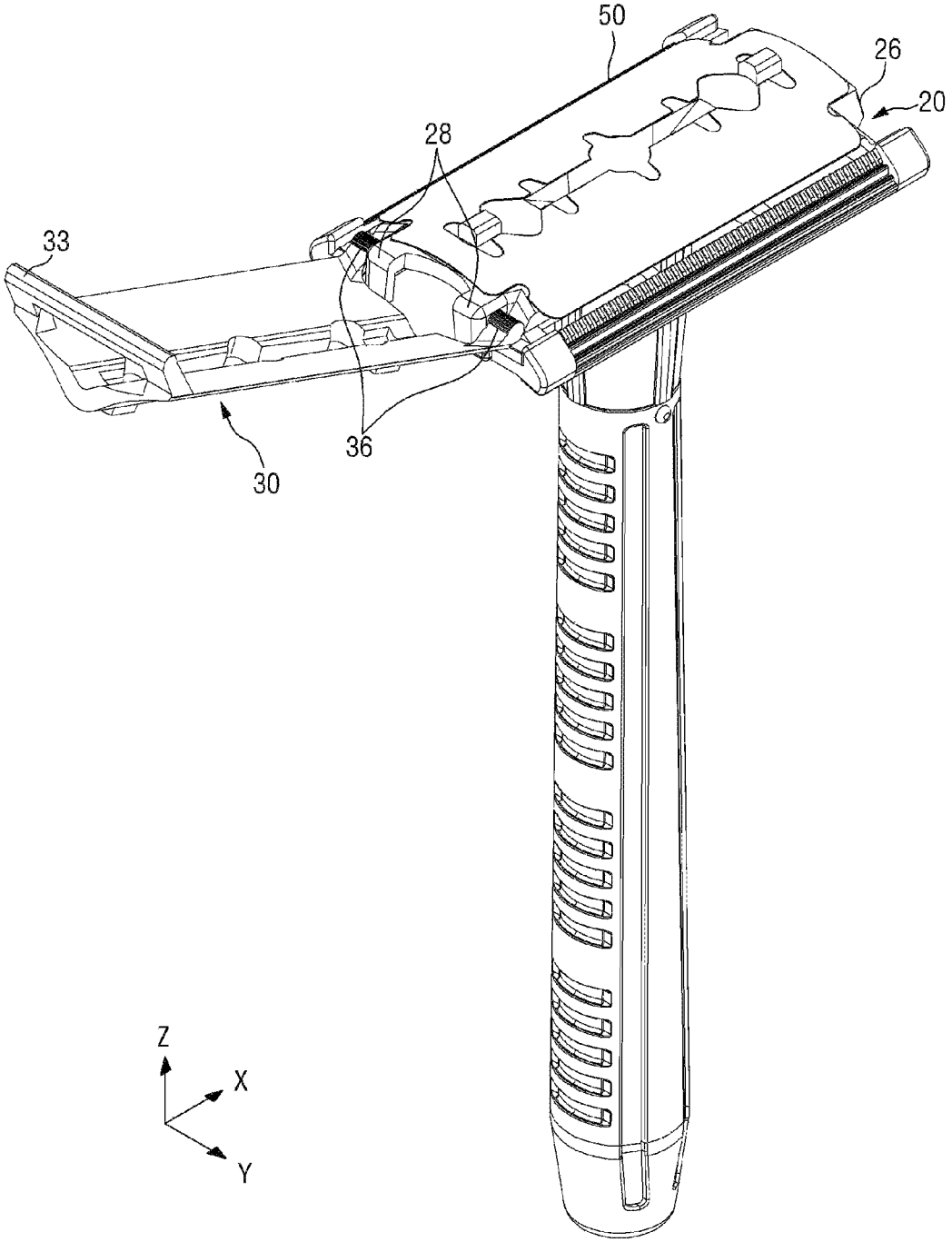

【FIG. 8B】
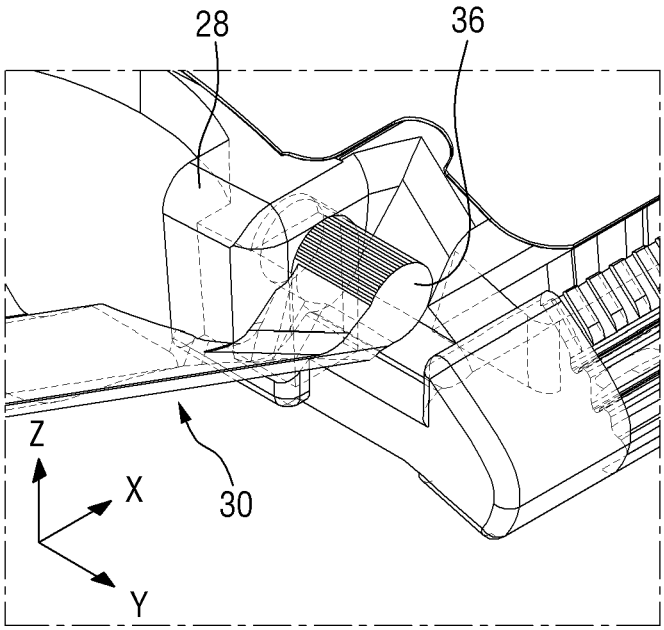
【FIG. 9】
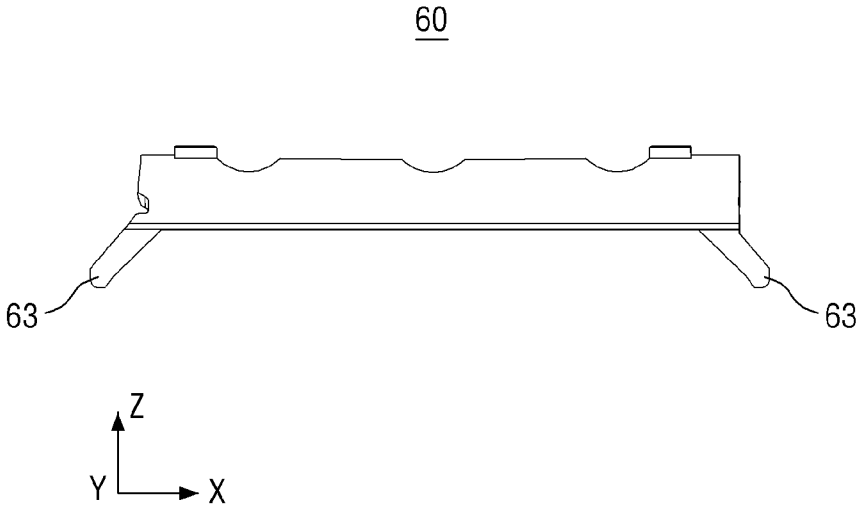

【FIG. 10】
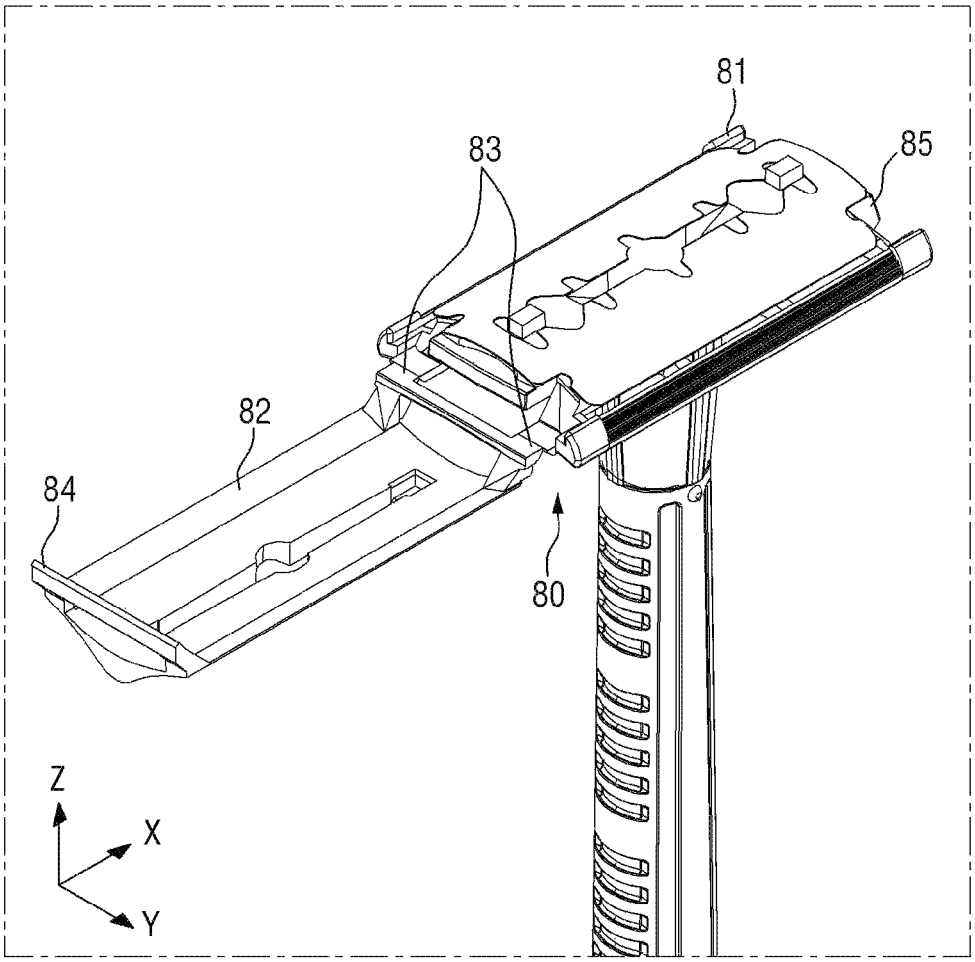

【FIG. 11】
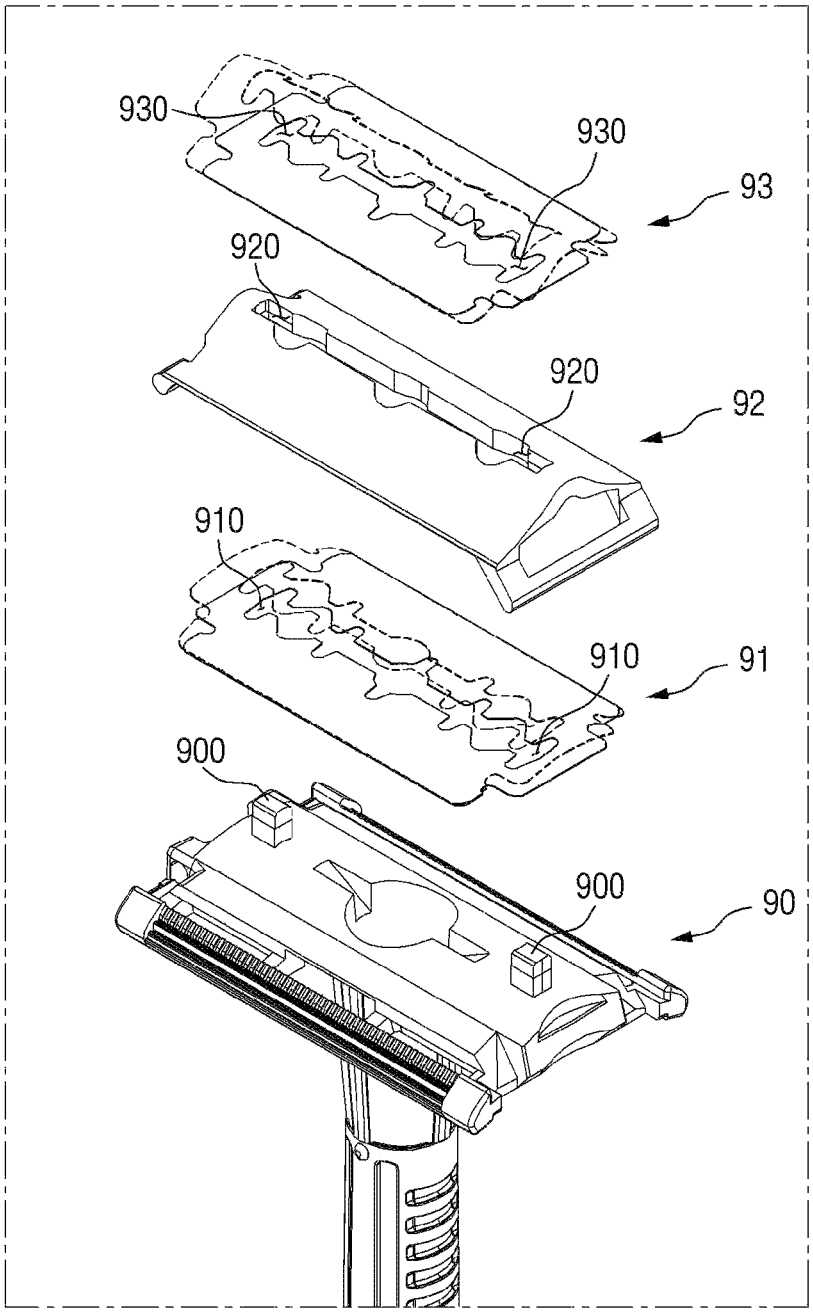

【FIG. 12】
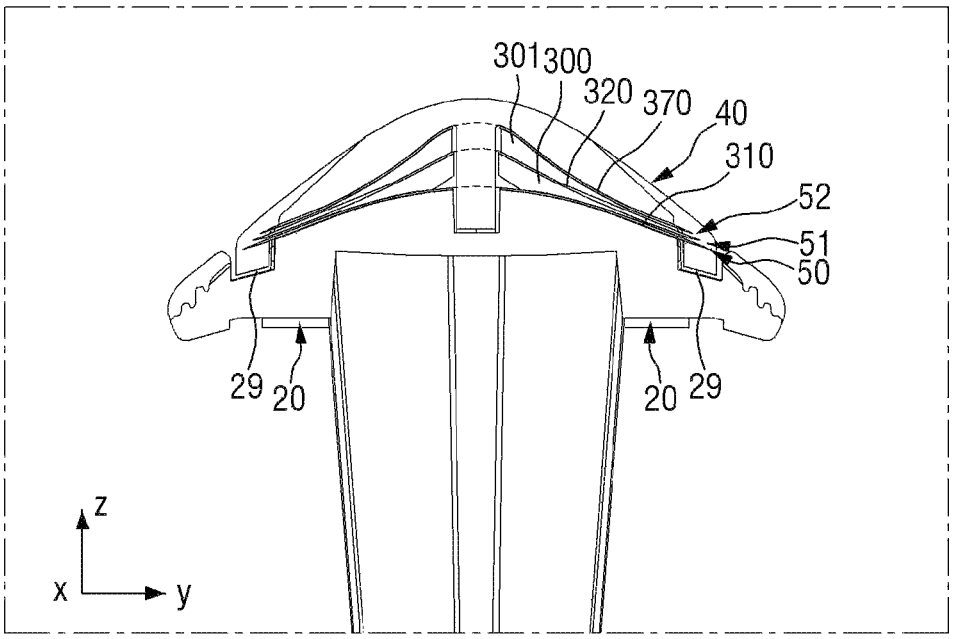

DUAL DOUBLE-EDGE RAZOR

CROSS-REFERENCE TO RELATED APPLICATIONS

This application is the National Stage filing under 35 U.S.C. 371 of International Application No. PCT/KR2017/012789, filed on Nov. 13, 2017, which claims the benefit of earlier filing date and right of priority to Korean Application No. 10-2016-0163134, filed on Dec. 2, 2016, the contents of which are all hereby incorporated by reference herein in their entirety.

TECHNICAL FIELD

The present invention relates to a razor, and more particularly, to a razor using double edge blades.

BACKGROUND ART

A typical double-edge razor consists of a razor and a double-edge blade used by being inserted and fixed in the razor. The double-edge blade is replaceable, and the razor can be used semi-permanently by periodically replacing the double-edge blade without replacing the entire razor.

The razor includes a handle, a frame connected to the handle, the double-edge blade mounted on the frame, and a top cap placed on top of the double-edge blade to fix the double-edge blade to the frame. The frame and the top cap may fix the double-edge blade disposed therebetween, and also allow only the edge portions of the double-edge blade to be exposed on the outer regions of the razor. The exposed edge portions of the double-edge blade may be used to cut hair.

Existing double-edge blade razors may generally use a single double-edge blade or multiple blades. However, since double-edge blade razors have a raised center as viewed from a side, two double-edge blades of different sizes may need to be provided at lower and upper portions of the razor, such that a first single double-edge blade is provided at a lower portion of the razor, and a second single-edge blade is provided at the top portion of the razor.

In other cases, when using double-bladed blades the direction of the protruding blade portions from the upper and lower portions may be different, or the protruding blade portion amounts may be different, and/or the edge portions of the upper and lower blades may not be parallel, leading to undesirable results.

To address the aforementioned problems, embodiments of the present invention provide a razor which is capable of allowing two double-edge blades of the same type to be inserted therein, without the need to install different type of blades, facilitating the maintenance, repair, and replacement of blades, and providing an improved cutting force and improved contact with the skin.

Additional advantages, benefits, and features of the present invention will be set forth in the following description and will be apparent to those having ordinary skill in the art.

SUMMARY OF INVENTION

According to an embodiment of the present invention, a razor may include: a handle; a frame coupled to one end of the handle; a spacer disposed above the frame; a top cap mounted at a top of the spacer; a first blade secured between the frame and the spacer; and a second blade secured between the spacer and the top cap, wherein the first blade is supported by at least a portion of a top surface of the frame and at least a portion of a bottom surface of the spacer such that a first profile of the first blade is convexly curved upward, and wherein the second blade is supported by at least a portion of a top surface of the spacer and at least a portion of a bottom surface of the top cap such that a second profile of the second blade comprises a curved central region that is convexly curved upward and a pair of curved side regions that are concavely curved downward on opposite sides of the central region.

In another embodiment, an angle formed by tangent lines at the cutting edges of the first blade is greater than an angle formed by tangent lines at inflection points of the curves between the curved central region and the pair of curved side regions of the second profile.

A curvature radius of the curved central region of the second profile may be smaller than a curvature radius of the pair of curved side regions of the second profile. In some embodiments, the frame and the spacer may be configured to secure the first blade at least at both ends of the first blade. The spacer may be configured to support at least part of the curved central region of the second blade, and the top cap may be configured to support at least part of the pair of curved side regions of the second blade.

In some embodiments, the razor may further include a first coupling portion disposed at one end of the handle and configured to be coupled with the frame; and a second coupling portion disposed at a bottom side of the top cap, wherein the first coupling portion and the second coupling portion are configured to be engaged. Some embodiments may further include a third coupling portion disposed at a first end of the frame and configured to be coupled to a fourth coupling portion disposed at a first end of the spacer; and a fifth coupling portion disposed at a second end of the frame opposite the first end and configured to be coupled to a sixth coupling portion disposed at a second end of the spacer opposite the first end.

In other embodiments, each of the first blade, the second blade, and the spacer is shaped to comprise at least one corresponding through hole; and the frame comprises a protruding boss configured to pass through the corresponding through holes of the first blade, the second blade, and the spacer to secure positions of the first blade, the second blade, and the spacer. Corresponding cutting edges of the first blade and cutting edges of the second blade may be disposed at opposing openings between the top cap and the frame extending in a longitudinal direction of the frame. The first and second blades may be double-edge blades having a same size. The first and second blades may have an originally flat shape and are configured to be bent according to a configuration of the frame, spacer, and top cap.

The first connecting portion may be a screw connector, and the second connecting portion may be a screw. Holes into which the second connecting portion is inserted may be formed at the spacer and the frame respectively, and the second connecting portion may be connected to the first connecting portion through the holes. The spacer may be connected to the frame by connecting a third connecting portion, which is disposed at one end of the frame, and a fourth connecting portion, which is disposed at one end of the spacer, and connecting a fifth connecting portion, which is disposed at the other end of the frame, and a sixth connecting portion, which is disposed at the other end of the spacer.

The third and fourth connecting portions may be hinge-connected, the fifth connecting portion may be a snap fit, and the sixth connecting portion may be a snap fit connector. The frame and the spacer may be integrally formed by forming the third and fourth connecting portions as an integral film hinge that is rotatable.

Each of the first and second blades may include at least one through hole in the middle thereof, a boss may be formed on the top surface of the frame and projects to pass through the through hole of the first blade, and a boss may be formed on the top surface of the spacer and projects to pass through the through hole of the second blade.

According to another embodiment, a razor includes a handle; and a razor head portion coupled to one end of the handle and comprising a plurality of blades mounted therein, wherein the plurality of blades are double-edge blades comprising cutting edges at opposite edges, and the plurality of blades are bent according to a configuration of the razor head portion, and each of the plurality of blades are curved to have different curvatures at central regions thereof. A curvature radius of a central region of a first blade of the plurality of blades may be smaller than a curvature radius of a central region of a second blade of the plurality of blades.

Other features and embodiments may be apparent from the following detailed description, the drawings, and the claims.

According to embodiments of the present invention, at least the following effects can be provided.

Since a double-edge blade razor using two double-edge blades of the same type is provided, there is no need to mount blades of different types in a razor, and it is easy for user to maintain, repair, and replace blades of a razor.

Since double-edge blades of the same type can be employed, and at the same time, an optimum projecting amount and an optimum cutting angle can be set with a simple structure, a user can be provided with improved closer to the skin and a safe shave.

The effects of the present invention are not limited to the above-described effects and other effects which are not described herein will become apparent to those skilled in the art from the following description.

BRIEF DESCRIPTION OF DRAWINGS

The above and other aspects and features of the present disclosure will become more apparent upon consideration of the following description of embodiments taken in conjunction with the accompanying drawings.

FIG. 1 is a perspective view of a razor according to an embodiment of the present invention;

FIG. 2 is an exploded perspective view of the razor according to an embodiment of the present invention;

FIG. 3 is a cross-sectional view showing the curvature radius of each profile of the razor according to an embodiment of the present invention, as viewed from a side of the razor;

FIG. 4A is a cross-sectional view showing the angle formed by both cutting edges of each blade of the razor according to an embodiment of the present invention and the angle formed by tangent lines drawn from inflection points in the central region of a second profile, as viewed from the side of the razor;

FIG. 4B is an enlarged view of an area of FIG. 4A, enclosed by a dotted line, showing the angles formed by pairs of tangent lines according to an embodiment;

FIG. 5 is a cross-sectional view showing the locations at which each blade is supported by a frame, a spacer, and a top cap, as viewed from the side of the razor according to an embodiment;

FIG. 6 is a plan view showing the razor according to an embodiment, as viewed from a top thereof, with the top cap removed;

FIG. 7 is a side view showing the spacer connected to the frame without the top cap and the second blade of the razor according to an embodiment;

FIG. 8A is a perspective view of an embodiment showing a spacer of the razor boss-hinge-connected to the lower portion of the frame so as to be rotatable;

FIG. 8B is an enlarged perspective view of boss-hinge-connected portions of FIG. 8A;

FIG. 9 is a side view showing an embodiment of the present disclosure showing a spacer of a razor having snap fit connectors as fourth and sixth connecting portions;

FIG. 10 is a perspective view showing a case where a spacer and a frame of a razor according to another embodiment of the present invention are integrally formed;

FIG. 11 is an exploded view of another embodiment of the present invention showing the assembly structure of the razor and a frame in which a further-extended frame boss of a razor is formed; and FIG. 12 is a cross-sectional view of another embodiment showing a razor which includes two spacers and three blades, as viewed from a side of the razor.

DETAILED DESCRIPTION OF THE INVENTION

Advantages and features of the present invention and methods of accomplishing the same may be understood more readily by reference to the following detailed description of embodiments and the accompanying drawings. The present invention may, however, be embodied in many additional different embodiments and should not be construed as being limited to the embodiments set forth herein. Rather, embodiments are provided herein so that this disclosure may fully convey the concept of the present invention to those skilled in the art, and the present invention will only be defined by the appended claims. It is to be understood by those of ordinary skill in this technological field that other embodiments may be utilized, and that structural, electrical, as well as procedural changes may be made without departing from the scope of the present invention.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. Like reference numerals refer to like elements throughout the specification.

Exemplary embodiments of the present invention will hereinafter be described with reference to the accompanying drawings.

FIG. 1 is a perspective view of a razor according to a first embodiment of the present invention.

Referring to FIG. 1, a razor head portion 11, which is formed as the body of a razor 1, is formed above a handle 10. The head portion 11 is coupled to one end of the handle 10 and is equipped with a plurality of blades. The razor 1 may be generally formed of a plastic material, but may also be formed of a metal or another material into which a plastic material or a metal are mixed.

FIG. 2 is an exploded perspective view of the razor according to the first embodiment.

Referring to FIG. 2, the elements of the razor 1 according to the first embodiment can be disassembled along the longitudinal direction of the handle 10 of the razor 1. The longitudinal direction of the handle 10 of the razor 1 will hereinafter be referred to as a z axis, and a positive z-axis direction will be referred to as an upward direction. Also, the x and y axes will hereinafter be referred to as shown in FIG. 3.

The handle 10 is disposed at a lower portion of the razor 1 as shown in FIG. 1, and a first coupling portion 101 is disposed at the handle 10, where a top cap 40 and a frame may be coupled to the first coupling portion 101, as discussed further below. The handle 10 is elongated and configured so that a user can easily grab, hold, and maneuver the razor 1 during use. As illustrated in FIG. 1, the handle 10 may be provided with a plurality of protrusions that are arranged along the longitudinal direction of the handle 10. In some embodiments, the protrusions may be shaped in a direction perpendicular to the longitudinal direction of the handle 10, thereby increasing the frictional force so that a better grip of the handle 10 can be provided when the user grabs and holds the razor 1 during use.

The razor head portion 11, which is formed as the body of the razor 1, includes the frame 20 which is coupled to the handle 10 and is configured to secure blades, a spacer 30 which is mounted above the frame 20 and configured to secure blades against the frame 20, and the top cap 40 which is configured to secure blades against the spacer 30 and is coupled to the handle 10 so as to maintain the coupling structure of the entire razor 1.

The frame 20 of the razor 1 according to the first embodiment may be coupled to the end of the handle 10 where the first coupling portion 101 is disposed. The frame 20 is one of the basic elements of the body of the razor 1 according to the first embodiment.

The frame 20 may be elongated in a direction perpendicular to the longitudinal direction of the handle 10 so that the blades can be mounted and used thereon.

A handle connecting portion 25, to which the end of the handle 10 can be coupled, may be formed at a bottom of the frame 20. The handle connecting portion 25 may protrude so as to be able to be coupled to the handle in the longitudinal direction of the handle 10. In some embodiments, the end of the handle 10 can be at least partially received in an opening corresponding to the handle connecting portion 25 when the handle 10 and the frame 20 are coupled. The opening may be configured to receive and secure the first coupling portion 101 therein.

In this case, a securing portion of the first coupling portion 101 may be engaged with the handle connecting portion 25 and may thus securely couple the handle 10 and the frame 20. Since the handle connecting portion 25 wraps around at least part of the handle 10, the handle 10 and the frame can be coupled more tightly than when the handle 10 is not wrapped and received by the handle connecting portion 25. However, the disclosure is not limited thereto, and additional securing configurations between the handle 10 and the handle and the frame may be considered by this disclosure as will be evident to those of ordinary skill in the art. Such configurations may prevent the razor head portion 11 from deviating from its initial fixed location when the user manipulates the handle 10 for shaving.

The inside of an opening of the handle connecting portion 25 may be configured to be coupled to the end of the handle 10 in a snap-fit manner so that the end of the handle 10 can be securely coupled and fixed thereto. The shapes of the handle connecting portion 25 and the end of the handle 10 are not particularly limited, and various modifications can be made thereto such that the handle connecting portion 25 and the end of the handle 10 are formed to correspond to each other and thus to be able to securely couple the handle 10 and the frame 20.

Referring to the embodiment of FIG. 1, a first blade 50 is mounted on the top surface of the frame 20. First blade 50 may be a double-edged blade. A first blade 50 used in conjunction with embodiments of the present disclosure may originally have a flat shape with cutting edges on opposing edges, or it may be a double-edged blade already having a convex central portion with cutting edges on opposing edges of the central portion. Where a first blade 50 has an original flat shape, the central portion of the first blade 50 may be bent according to a convex shape of the top surface of the frame 20 when the first blade 50 is mounted to the frame. A first blade 50 already having a bent shape with a convex central portion may be further bent or fitted to the top surface of the frame 20 when the first blade 50 is mounted to the frame.

The first blade 50 may be mounted on the top surface of the frame 20, however the first blade 50 may not necessarily contact the frame 20 at every position of a frame upper surface 21. Thus, at least part of the first blade 50 may be supported by the frame upper surface 21, and the frame upper surface 21 may support the first blade 50 at least partially at both ends of the first blade 50 so that the curvature of the first blade 50 can be formed. This will be described later in detail, together with a first profile 31.

The frame upper surface 21 may be formed to substantially correspond to an x-y plane as shown in FIG. 1, but a portion of the frame upper surface may be convexly projected in an upward direction to increase an area for supporting the first blade 50.

In some embodiments, the first blade 50 may include at least one first blade through hole 500. The through hole 500 may be elongated along a centerline of the first blade 50, and include more than one through hole. For example, a first blade hole 501 may be formed in the middle of the first blade 50. The first blade through hole 500 and the first blade hole 501 may be formed separately, but the present invention is not limited thereto. That is, alternatively, the first blade through hole 500 and the first blade hole 501 may be integrally formed.

In some embodiments, at least one frame boss 22 may project from the frame upper surface 21 and be disposed along the centerline of the frame upper surface 21. The frame boss 22 may be disposed at a location corresponding to the first blade through hole 500 and may be configured to penetrate the first blade through hole 500 when the first blade 50 is mounted on the frame upper surface 21. A corresponding groove (not illustrated) may be formed at the bottom of the spacer 30 and configured to receive and secure the frame boss 22 such that the frame 20 and the spacer 30 can be further securely coupled, fixing a position of the first blade 50 therebetween. Accordingly, the frame boss 22 can prevent the first blade 50 from deviating from its position against the frame upper surface 21.

FIG. 2 illustrates an embodiment wherein the frame upper surface 21 includes two frame bosses 22 and the blade includes two corresponding first blade through holes 500. However, the numbers of frame bosses 22 and numbers of first blade through holes 500 are not particularly limited. That is, other embodiments are considered in which only one frame boss 22 and only one first blade through hole 500 may be formed, or three or more frame bosses 22 and three or more first blade through holes 500 may be formed, and the like.

First blade cutting edges 502, which can cut hair, may be formed on opposing edges of the first blade 50. A frame hole 23, may be formed in a middle region of the top surface of the frame 20, and in some embodiments, the frame hole 23 may be shaped to be elongated along a longitudinal direction of the frame 20. The frame hole 23 may be configured to receive a second connecting portion 41 of the top cap 40, as will be discussed further below.

In some embodiments, the frame may further include guard bars 24 disposed at opposing edges of the frame 20. The guard bars 24 may be disposed to be adjacent to the cutting edges of the first blade 50 when the first blade 50 is secured to the frame. The guard bars 24 may be used to define a shaving plane, P, by adjusting—together with the top cap 40—an amount of the cutting edges of the blade which protrude to contact skin during shaving. It will be described later, with reference to FIG. 3, how the guard bars 24 are configured define the shaving plane P together with the top cap 40.

The guard bars 24 may be formed of the same material as the frame 20. For example, the guard bars 24 may be formed of a rubber material, or at least part of the frame 20 that is generally formed of a material such as a plastic material may be formed of a rubber material and may thus perform the functions of the guard bars 24. These types of rubber guards may be placed in contact with the skin and may pull the skin when dragged across the skin surface so as to facilitate shaving. In another example, the guard bars 24 may be provided as comb guards to comb and align hair when dragged across the skin surface before the hair is reached by blades during shaving. In another example, lubrication bands may be provided at the guard bars 24 and may provide lubrication to the skin to protect the skin and to provide a smooth shave. However, the present invention is not limited to these examples.

In some embodiments, the frame may also include groove portions 29 formed between the guard bars 24 and the frame upper surface 21. The groove portions 29 may be elongated along the frame and may be configured to divide the guard bars 24 and the frame upper surface 21. The groove portions 29 may be formed to have a shape corresponding to the shape of top cap corners 45, which are the corner portions of the top cap 40, and thus may be shaped to correspondingly receive the top cap corners 45. The top cap corners 45 may be inserted into the groove portions 29 thus preventing the top cap 40 from laterally movement as the range of movement of the top cap corners 45 may be limited by sidewalls of each of the groove portions 29.

In some embodiments, the groove portions 29 may include openings at a bottom surface of the groove portion 29, referred to as frame through holes 27. FIG. 2 illustrates that a total of three frame through holes 27 are formed at each of the groove portions 29, but the present invention is not limited thereto, and different numbers of frame through holes 27 are considered in other embodiments.

The frame through holes 27 may be configured to allow shaving residues generated during shaving to pass to the outside of the razor 1. The first blade cutting edges 502 of the first blade 50 and second blade cutting edges 512 of a second blade 51 may be located adjacent to the groove portions 29, which provide spaces between the guard bars 24 and a top surface 44 of the top cap 40. The frame through holes 27, which are openings formed at bottom surfaces of the groove portions 29, may be located directly below the first blade cutting edges 502 of the first blade 50 and the second blade cutting edges 512 of the second blade 51. In this case, shaving residues generated by the first blade cutting edges 502 and the second blade cutting edges 512 can be easily discharged in a downward direction via the groove portions 29 and the frame through holes 27. Additionally, the configuration allows for rinsing out of shaving residue which is below the first blade cutting edges 502 and the second blade cutting edges 512.

In some embodiments, the frame 20 may further include fifth and third connecting portions 26 and 28 formed at opposite ends of the frame in the x-axis direction. The interactions between the fifth and third connecting portions 26 and 28 and sixth and fourth connecting portions 33 and 36 will be described later with reference to FIG. 7.

The spacer 30 is an element of the razor 1 that determines at least part of the first profile 31 and at least part of a second profile 32 and determines the distance between the first and second blades 50 and 51.

The bottom surface of the spacer 30 is configured to be seated on the top surface of the first blade 50, which is in turn seated on the top surface of the frame 20. Thus, the first blade 50 may be fixed between the top surface of the frame 20 and the bottom surface of the spacer 30.

The first blade 50 may be supported by being at least partially in contact with the bottom surface of the spacer 30 and the top surface of the frame 20, and as a result, the bottom surface of the spacer 30 and the top surface of the frame 20 may determine a shape into which the first blade 50 is to be bent when the assembly of the razor 1 is complete. The bent shape of the first blade 50 is referred to as the first profile 31. The bent shape of the first blade 50 may be determined by the bottom surface of the spacer 30 and the top surface of the frame 20.

Embodiments of the present disclosure also include a second blade 51, which may be a double-edge blade and is mounted on the top surface of the spacer 30. A second blade 51 used in conjunction with embodiments of the present disclosure may originally have a flat shape with cutting edges on opposing edges, or it may be a double-edged blade already having a convex central portion with cutting edges on opposing edges of the central portion. Where a second blade 51 has an original flat shape, the central portion of the second blade 51 may be bent according to a shape of the top surface of the spacer 30 when the second blade 51 is mounted. A second blade 51 already having a bent shape with a convex central portion may be further bent or fitted to the top surface of the spacer 30 when the second blade 51 is mounted.

In some embodiments, the first and second blades 50 and 51 may be of the same type. That is, blades of the same type may be used without regard to their installation locations. In other embodiments, the first and second blades 50 and 51 may be of different types. Referring to FIG. 2, the original shapes of the first and second blades 50 and 51, illustrated with solid lines, show that the first and second blades 50 and 51 are originally flat when they are yet to be assembled into the razor 1, and the resulting shapes of the first and second blades 50 and 51, illustrated with dotted lines, show that the first and second blades 50 and 51 may be bent once they are assembled into the razor 1.

The second blade 51 may be mounted on the top surface of the spacer 30, but may not necessarily contact the spacer 30 at all positions on the top surface of the spacer 30. Thus, at least part of the second blade 51 may be supported by the top surface of the spacer 30. The top surface of the spacer 30 may be formed to substantially correspond to the x-y plane, but a portion of the top surface of the spacer 30 may be convexly projected in the upward direction to increase an area for supporting the second blade 51.

In some embodiments, the second blade 51 may include at least one second blade through hole 510. The second blade through hole 510 may be elongated along a centerline of the second blade 51, and include more than one through hole. For example, a second blade hole 511 may be formed in the middle of the second blade 51. The second blade through hole 510 and the second blade hole 511 may be formed separately, but the present invention is not limited thereto. That is, alternatively, the second blade through hole 510 and the second blade hole 511 may be integrally formed.

In some embodiments, at least one spacer boss 34 may project from the top surface of the spacer 30. The spacer boss 34 may be disposed at a location corresponding to the second blade through hole 510 and may be configured to penetrate the second blade through hole 510 when the second blade 51 is mounted on the top surface of the spacer 30. A corresponding groove (not illustrated) may be formed at the bottom of the top cap 40 and configured to receive and secure the spacer boss 34 such that the spacer 30 and the top cap 40 can be further securely coupled. Accordingly, the spacer boss 34 can prevent the second blade 51 from deviating from its position against the top surface of the spacer 30.

FIG. 2 illustrates an embodiment wherein the top surface of the spacer 30 includes two spacer bosses 34 and the second blade 51 includes two second blade through holes 510. However, the numbers of spacer bosses 34 and numbers of second blade through holes 510 are not particularly limited. That is, other embodiments are considered in which only one spacer boss 34 and only one second blade through hole 510 may be formed, or three or more spacer bosses 34 and three or more second blade through holes 510 may be formed, and the like.

Second blade cutting edges 512, which can cut hair, may be formed on opposing edges of the second blade 51. A spacer hole 35 may be formed in a middle region of the top surface of the spacer 30, and in some embodiments, the spacer hole 35 may be shaped to be elongated along a longitudinal direction of the spacer 30. The spacer hole 35 may be configured to receive the second connecting portion 41 of the top cap 40, as will be discussed further below.

The sixth and fourth connecting portions 33 and 36 may be formed at opposite ends of the spacer 30, in the x-axis direction. The interactions between the fifth and third connecting portions 26 and 28 and the sixth and fourth connecting portions 33 and 36 will be described later with reference to FIG. 7.

The bottom surface of the top cap 40 is configured to be seated on the top surface of the second blade 51, which is in turn seated on the top surface of the spacer 30. Thus, the second blade 51 may be fixed between the top surface of the spacer 30 and the bottom surface of the top cap 40.

The second blade 51 may be supported by being at least partially in contact with the bottom surface of the top cap 40 and the top surface of the spacer 30, and as a result, the bottom surface of the top cap 40 and the top surface of the spacer 30 may determine a shape into which the second blade 51 is to be bent when the assembly of the razor 1 is complete. The bent shape of the second blade 51 is referred to as the second profile 32. The bent shape of the second blade 51 may be determined by the bottom surface of the top cap 40 and the top surface of the spacer 30.

The top cap 40, which is an element formed at the top of the razor 1 according to the first embodiment, covers the razor 1 and is used to define the shaving plane P together with the guard bars 24. The top and bottom surfaces of the top cap 40 are formed to be convexly curved in the upward direction.

The second coupling portion 41 is disposed at the center of the bottom surface of the top cap 40. The second coupling portion 41, which is an element of the top cap 40 that is coupled and fastened to the first coupling portion 101 at one end of the handle 10, may be formed to project in a downward direction toward the handle 10.

The second coupling portion 41 is coupled and fastened to the first coupling portion 101 disposed at the end of the handle 10, which is coupled to the handle connecting portion 25 via the second blade hole 511, the spacer hole 35, the first blade hole 501, and the frame hole 23. Thus, the second coupling portion 41 may be formed to have a smaller diameter than the second blade hole 511, the spacer hole 35, the first blade hole 501, and the frame hole 23 and may thus be able to pass through the second blade hole 511, the spacer hole 35, the first blade hole 501, and the frame hole 23.

The first and second coupling portions 101 and 41 may be implemented as a screw coupler and a screw, respectively, and may thus be screw-coupled to each other. Accordingly, the first and second coupling portions 101 and 41 can be firmly coupled to each other and can be easily assembled or disassembled by the user. Alternatively, the first and second coupling portions 101 and 41 may be implemented as a screw and a screw coupler, respectively, or various other modifications can be made to the shapes of the first and second coupling portions 101 and 41.

Top cap projecting portions 42 are formed at both ends, in the x-axis direction, of the top cap 40. Thus, the user can easily hold and grip the top cap 40 when assembling the top cap 40 to, or disassembling the top cap 40 from, the razor 1.

The shapes of the first and second profiles of the razor according to the first embodiment will hereinafter be described with reference to FIGS. 3 through 5.

FIG. 3 is a cross-sectional view showing the curvature radius of each profile of the razor according to the first embodiment, as viewed from a side of the razor.

Referring to FIG. 3, once the assembly of the razor 1 according to the first embodiment is complete, the first blade cutting edges 502 and the second blade cutting edges 512 are located in the space between the top cap 40 and the guard bars 24. Also, the first blade cutting edges 502 and the second blade cutting edges 512 are slightly projected from the inside of the razor head portion 11 to the outside of the razor head portion 11 with respect to the shaving plane P formed by the top cap 40 and the guard bars 24.

Referring to FIG. 3, directions indicated by a double-sided arrow on the outside of the razor 1 are defined as shaving directions D. One side of the shaving direction D is a direction in which the razor 1 is moved and cuts hair during shaving performed using the razor 1, and the opposite side correspondingly indicates the direction in which skin travels past the razor during shaving.

An imaginary plane formed by a tangent line that touches both the guard bars 24 and the top cap top surface 44 is defined as a shaving plane P. The guard bars 24 may be positioned distal from a center point of the razor along the y-axis as compared with the second blade cutting edges 512 as shown in FIG. 3. That is, the surface where the top cap top surface 44 and the guard bars 24 are placed in contact with the skin during shaving corresponds to the shaving plane P.

The first blade cutting edges 502 and the second blade cutting edges 512 are located in a space adjacent to the shaving plane P. As described above, the space may be between the guard bars 24 and the top cap 40. in some embodiments, the first blade cutting edges 502 and the second blade cutting edges 512 may project beyond the shaving plane P toward the outside of the razor 1 or in some embodiments they may be located further inside the razor 1 than the shaving plane P.

Referring to FIG. 3, the shapes of the first profile 31 of the first blade 50 and the second profile 32 of the second blade 51 may be identified. The first profile 31 and the second profile 32 may be the result of bending the first blade 50 and the second blade 51 according to the frame, 20, the spacer 30, and the top cap 40, as discussed above.

The first profile 31 of the first blade 50 may be formed between the top surface of the frame 20 and the bottom surface of the spacer 30 and may correspond to a convex curved in the upward direction, where at least part of the first blade 50 is supported between the top surface of the frame 20 and the bottom surface of the spacer 30.

A second profile central region 321 is formed between the spacer 30 and the top cap 40 to be convexly curved in the upward direction, where at least part of the second blade 51 is supported between the top surface of the spacer 30 and the bottom surface of the top cap 40. In some embodiments, a pair of second profile curvature regions 323 may be formed between the second profile central region 321 and the second blade cutting edges 512 to be concavely curved in the downward direction. In other words, the second profile 32 may not be a curved line that is convex only in one direction, but in some embodiments the second profile 32 may be formed as a curved line that is upwardly convex in the central region 321 and downwardly concave in the opposing curvature regions 323.

The first and second profiles 31 and 32 may both include convexly curved portions in the central regions thereof. The first and second profiles 31 and 32 may be formed as a result of installing the first and second blades 50, 51 in the razor 1, or in some cases the first and second blades 50, 51 may already include the first and second profiles 31, 32. However, the first and second blades 50 and 51 may be curved to have different curvatures in the central regions thereof. In some embodiments, the curvature radius of the central region of the second blade 51 may be formed to be smaller than the curvature radius of the central region of the first blade 50. That is, in some embodiments the curvature radius of the second profile central region 321 may be formed to be smaller than the curvature radius of the central region of the first profile 31. Thus, in certain embodiments, the projecting amounts and the projecting angles of two pairs of cutting edges (502, 512) of two blades may be similar or identical to each other in a double-edge blade razor 1 having a triangular side cross-sectional shape, as can be identified over the y-z plane. In order to achieve this, the degrees of curvature of upper and lower blades may need to be adjusted differently. Thus, as already mentioned above, the first and second profiles 31 and 32, which are different from each other, are provided.

The first profile 31 may have a shape that is convexly curved in the upward direction. In the razor 1 according to the first embodiment, the curvature radius of the first profile central region 311 is maintained through the entire first profile 31, i.e., the first profile 31 has a single curvature radius. Alternatively, the locations of the bottom surface of the spacer 30 and the top surface of the frame 20 that are placed in contact with the first blade 50 may be adjusted so that the first profile 31 can be configured to have one or more curvature radiuses.

The curvature radius of the first profile 31 may be formed to be greater than the curvature radius of the second profile central region 321. As described above, the cross-sectional shape of the razor head portion 11, as viewed from the y-z plane shown in FIG. 3, is similar to a triangular shape. Thus, the width, in the y-axis direction, of the first profile 31 may be greater than the width, in the y-axis direction, of the second profile 32 because the second profile 32 may be more curved than the first profile 31 in order to make the pairs of first blade and second blade cutting edges 502 and 512 project by the same amount, or by similar amounts, with respect to the first and second profiles 31 and 32.

The curvature radius of the second profile central region 321 may be formed to be smaller than the curvature radius of the second profile curvature regions 323. If the curvature radius of the second profile central region 321 is maintained throughout the entire second profile 32, it may be difficult to maintain the angle that the second blade cutting edges 512 form with the shaving plane P to provide an appropriate cutting angle during shaving. Even if the angle that the second blade cutting edges 512 form with the shaving plane P is within an appropriate range of cutting angle, the projecting amount of the second blade cutting edges 512 past the shaving plane P may be different from the projecting amount of the first blade cutting edges 502 past the shaving plane P. The angles formed by the first blade cutting edges 502 and the second blade cutting edges 512 with respect to the y-z plane will hereinafter be described with reference to FIGS. 4A and 4B.

FIG. 4A is a cross-sectional view showing the angle formed by both cutting edges of each blade of the razor 1 according to the first embodiment and the angle formed by tangent lines drawn from inflection points in the central region of the second profile 32, as viewed from a side of the razor 1, and FIG. 4B is an enlarged view of an area of FIG. 4A, enclosed by a dotted line, showing the angles formed by pairs of tangent lines.

Referring to FIGS. 4A and 4B, the first and second profiles 31 and 32, which are indicated in terms of curvature radius, as shown in FIG. 3, are indicated in terms of angle.

The angle formed by the shaving plane P (represented as a straight line in the cross-sectional view of FIG. 4A), and the first blade cutting edges 502 and the angle formed by the shaving plane P and the second blade cutting edges 512 may be in the range of 15° to 29°, and preferably, 20° to 24° to provide a safe shave with improved contact with the skin. If the angles formed by the shaving plane P and first blade and second blade cutting edges are too large or small, the cutting edges of each of the blades may be oriented too vertically with respect to the skin, instead of being oriented in a direction suitable for shaving, and thus, shaving may not be able to be properly performed. When the angle between the shaving plane and the razor blade is larger than the aforementioned angle range, the cutting edge of the razor blade may be oriented too horizontally with respect to the skin, thus causing poor hair cutting results. Particularly, if the angles formed by the shaving plane and the first and second blade cutting edges are less than the aforementioned angle ranges, the skin may easily get scratched or hurt by the blades during shaving. Thus, the first and second profiles 31 and 32 are provided to ensure cutting edges 502 and 512 form an angle with respect to the shaving plane P within the acceptable range of angles for an effective and safe shave.

Referring to the second profile 32, in some embodiments each of the second profile curvature regions 323 between the second blade cutting edges 512 and the second profile central region 321 forms a curved line that is downwardly concave, and the second profile central region 321 forms a curved line that is upwardly convex. Thus, in order for a curved line to be downwardly concave and then upwardly convex without discontinuity, there must be an inflection point in the curved line where the slope changes. Since the slope of the second profile 32 must have changed in the left half of the second profile 32 with respect to the central region 321, the slope of a tangent line drawn from the inflection point in the second profile 32 would be greater than the slope of a tangent line drawn from anywhere else in the second profile 32.

Referring to FIG. 4B, an angle A1 formed by the tangent lines of the first blade cutting edges 502 and an angle A3 formed by the tangent lines of the second blade cutting edges 512 may be configured to be greater than an angle A2 formed by tangent lines at inflection points near the center of the second profile 32. Also, the angle A1 formed by the tangent lines of the first blade cutting edges 502 and the angle A3 formed by the tangent lines of the second blade cutting edges 512 may be configured to be the same for similar reasons to those described above with regard to the curvature radius of the first profile 31 and the curvature radius of the second profile central region 321. Since the first blade 50, which is bent along the first profile 31, and the second blade 51, which is bent along the second profile 32, have different widths in the y-axis direction because of the almost triangular side cross-sectional shape of the razor head portion 11, as viewed from the y-z plane, the second profile 32 needs to be more curved than the first profile 31 in order for the pairs of cutting edges to have the same projecting amount or similar projecting amounts.

The tangent lines of each of the pairs of cutting edges 502 and 512 refer to the tangent lines on the y-z plane, as shown in FIGS. 3 through 5, because the blades 50 and 51 are bent into a curved shape along the first or second profile 31 or 32.

FIG. 5 is a cross-sectional view showing the locations at which each blade is supported by the frame, the spacer, and the top cap, as viewed from a side of the razor according to the first embodiment.

Referring to FIG. 5, arrows indicate the locations where the first and second blades 50 and 51 may be supported by various portions of the razor. In one embodiment as shown in FIG. 5, the first and second blades 50, 51 may be supported at the portions indicated by the arrows on the top surface of the frame 20, the bottom surface of the spacer 30, the top surface of the spacer 30, and the bottom surface of the top cap 40.

Thus in some embodiments, the first and second profiles 31 and 32 may not be formed by supporting the entire surfaces of the first and second blades 50 and 51 with surfaces of the frame 20, the spacer 30, and the top cap 40, but they may instead be formed by supporting the first and second blades 50 and 51 at only some regions, as indicated.

The first blade 50 may be bent into the shape of the first profile 31 of the razor 1 according to the first embodiment by being supported by the frame upper surface 21 and the bottom surface of the spacer 30 only at first profile end portions 312 adjacent to the first blade cutting edges 502. As discussed, the first profile 31 may only have a single curvature radius and configured to be upwardly convex. Thus, simply by at least partially fixing both ends of the first blade 50, a single curvature radius can be formed.

The second blade 51 may have the curvature radius of the second profile central region 321, described above with reference to the embodiment shown in FIG. 3, by being supported upwardly, in at least part of the second profile central region 321, by the top surface of the spacer 30. Also, the second blade 51 may have the curvature radius of the second profile curvature regions 323, described above with reference to the embodiment shown in FIG. 3, by being supported upwardly, in at least part of the second profile end portions 322 adjacent to the second blade cutting edges 512, by the top surface of the spacer 30 and being supported downwardly, in at least part of the second profile curvature regions 323, by the top cap bottom surface 43.

FIG. 6 is a plan view showing the razor according to the first embodiment, as viewed from the top thereof, with the top cap removed. Specifically, FIG. 6 is a plan view showing the second blade 51 mounted on the top surface of the spacer 30, as viewed from the top of the razor according to the first embodiment.

Referring to FIG. 6, at least one spacer boss 34 may upwardly pass through at least one second blade through hole 510. The spacer boss 34 may prevent the second blade 51 from deviating from its position at the top surface of the spacer 30.

A second blade hole 511 may be formed in the middle of the second blade 51, and the second coupling portion 41 of the top cap 40 may pass through the second blade hole 511 to be coupled to the first coupling portion 101, which is disposed at the end of the handle 10, thereby supporting the second blade 51 between the top cap 40 and the spacer 30.

FIG. 7 is a side view of an embodiment showing the spacer 30 coupled to the frame 20, wherein the top cap 40 and the second blade 51 of the razor 1 have been removed. Specifically, FIG. 7 is a view showing how the spacer 30 is coupled to the frame 20 such that the first blade 50 is supported between the spacer 30 bottom surface and the frame upper surface 21.

Referring to FIG. 7, the third and fifth coupling portions 28 and 26 are disposed at both ends of the frame 20, in the x-axis direction, and the corresponding fourth and sixth coupling portions 36 and 33 are disposed at both ends of the spacer 30, in the x-axis direction.

When the first blade 50 is mounted on the top surface of the frame 20 and the bottom surface of the spacer 30 is mounted on the first blade 50, the third coupling portion 28 of the frame 20 may be configured to be coupled to the fourth coupling portion 36 of the spacer 30, and the fifth coupling portion 26 of the frame 20 may be configured to be coupled to the sixth coupling portion 33 of the spacer 30. Thus, the coupling portions at both ends of the frame 20 and the spacer 30 may be configured to be coupled, thereby firmly coupling and fixing the first blade 50 between the frame upper surface 21 and the bottom surface of the spacer 30.

The corresponding coupling portions, 28 and 36, 26 and 33, may be configured to be hinge-coupled, or in other embodiments they may be implemented as a snap fit and a snap fit coupler, respectively, and may be snap-fit-coupled.

As will be understood by those of ordinary skill in the art, snap-fit coupling refers to forming a coupled state without deflection using a material with elasticity such as plastics, after undergoing a temporary deflected state, from a state yet to be coupled, due to an external force. For snap-fit coupling, a snap fit and a snap fit coupler in which the snap fit can be received are needed. FIG. 2, shows an example of a snap fit as a latching protrusion, and the snap fit coupler as a rectangular ring. Thus, the snap fit coupler may be deflected in order for the protruding snap fit to be received in the ring of the snap fit coupler, and once the rectangular ring reaches the latching protrusion of the snap fit, a snap fit coupling is achieved that holds them together and prevents them from being separated. In order to release the snap fit coupling, an external force may be needed to be applied in a direction away from the snap fit while holding the snap fit. Then, the snap fit coupler is deflected and is detached from the snap fit, and as a result, the snap fit and the snap fit coupler are separated.

Embodiments are considered in the coupling portions all use the same coupling configuration, or other embodiments are considered in which one pair of coupling portions are coupled together using one configuration and the other pair of coupling portions are coupled together using another different configuration. For example, in the razor 1 according to an embodiment as illustrated in FIG. 7, the third and fourth coupling portions 28 and 36 may be hinge-coupled, and the fifth and sixth coupling portions 26 and 33 may be formed as a snap fit and a snap fit coupler, respectively, and are snap-fit-coupled.

In embodiments utilizing a snap fit configuration, at least part of the exterior of each of the coupling portions may be engraved or textured to provide a gripping surface so that the user can easily hold the snap fits to uncouple them through the application of an external force.

FIG. 8A is a perspective view showing the spacer 30 according to an embodiment. In the embodiment shown, the spacer 30 may be boss-hinge-coupled to the lower portion of the frame 20 so as to be rotatable.

Referring to the embodiment of FIG. 8A, the sixth coupling portion 33 is formed at one end of the spacer 30, the fifth coupling portion 26, which corresponds to the sixth coupling portion 33, is formed at one end of the frame 20, where the sixth and fifth coupling portions 33 and 26 are formed as a snap fit coupler and a snap fit, respectively, to be snap-fit-coupled to each other. The fourth coupling portion 36 is formed at the other end of the spacer 30, the third coupling portion 28, which corresponds to the fourth coupling portion 36, is formed at the other end of the frame 20 corresponding to the end of the spacer 30 where the fourth coupling portion 36 is formed, where the fourth and third coupling portions 36 and 28 are formed as a hinge boss and a hinge slot, respectively. Thus, the fourth and third coupling portions 36 and 28 may be hinge-coupled to each other. The third, fourth, fifth, and sixth coupling portions 26, 28, 33, and 36 are coupled and fastened and can thus be fixed between the frame 20 and the spacer 30. The first blade 50 can be replaced by separating the fifth and sixth coupling portions 26 and 33 and rotating the spacer 30 about the hinge formed at third and fourth coupling portions 28 and 36, which are hinge-coupled to each other, so as to detach the spacer 30 from the top surface of the first blade 50 with ease.

FIG. 8B is an enlarged perspective view of boss-hinge-connected portions of FIG. 8A.

The spacer 30 of the razor according to the first embodiment may have a hinge boss as the fourth coupling portion 36, and the hinge boss may be coupled to the third coupling portion 28, which is formed at the bottom surface of the frame in the shape of a hinge slot.

Thus, the spacer 30, which is boss-hinge-coupled to the frame 20, may be rotatable with respect to the frame 20 about an axis defined by the hinge boss and the hinge slot. FIGS. 8A and 8B depict an embodiment where the spacer 30 is rotated by a predetermined angle from the frame upper surface 21.

As will be understood by those of ordinary skill, the hinge boss may be in the shape of a cylinder or a cylindroid. The hinge slot may be implemented as a cylindrical opening corresponding to the shape of the hinge boss and may be formed to correspond to the hinge boss, which is in the shape of a cylinder or a cylindroid. The shape of the hinge boss is not particularly limited but may vary as long as the hinge boss can be formed to correspond to the hinge slot and to be rotatable within the hinge slot. The contact surface between the hinge boss, which is formed in the shape of a cylinder, and the hinge slot may be uneven so that the spacer 30 can intermittently rotate. Only one hinge boss and only one hinge slot may be formed, but in the first embodiment, a total of two hinge bosses are formed on both sides, in the y-axis direction, of the frame 20, and a total of two hinge slots are formed on both sides, in the y-axis direction, of the spacer 30. However, the numbers of hinge bosses and hinge slots are not particularly limited, and more than two hinge bosses and more than two hinge slots may be formed.

FIG. 9 is a side view showing a second embodiment having a spacer with snap fit couplers. For example, FIG. 9 shows a case where fourth and sixth coupling portions 63 are formed as snap fit couplers, as described above. In this case, third and fifth coupling portions are formed as snap fits and are snap-fit-coupled to the fourth and sixth coupling portions 63 so as to couple the spacer 60 to the frame.

FIG. 10 is a perspective view showing an embodiment in which a spacer and a frame of a razor are integrally formed. In the third embodiment as illustrated in FIG. 10, a top cap and a second blade are separated, and a spacer 82 is opened.

The spacer 82 of the depicted embodiment may include a hinge instead of coupling portions. In another embodiment of the present disclosure, the third and fourth coupling portions may be integrally formed to form a film hinge 83 that is flexible. The film hinge 83 may not comprise a hinge structure formed by coupling a hinge rod and a hinge slot, but instead may include a movable permanent connecting portion having a shape of a notch or the like and formed to be thinner than the surrounding material such that the connected members are rotatable due to the elastic or flexible characteristics of the film hinge 83.

Referring to FIG. 10, a first blade may be mounted on the top surface of a frame portion 81 in a state where a spacer portion 82 included in a frame-spacer 80 of the razor is opened. The spacer portion 82 may be rotated about the film hinge 83 to cover the top surface of the first blade. As the spacer portion 82 is rotated, the film hinge 83 is deflected. The spacer portion 82 is coupled to the frame portion 81 by coupling fifth and sixth coupling portions 85 and 86, and as a result, the first blade is supported by the spacer portion 82 and the frame portion 81.

By providing the film hinge 83 comprising the third and fourth coupling portions, the frame portion 81 and the spacer portion 82 may be integrally formed. In some embodiments, the frame-spacer 80 which comprises the frame portion 81 and the spacer portion 82, is formed through injection molding. Thus, the effect of simultaneously forming a frame and a spacer through injection molding can be achieved, and as a result, the manufacturing cost can be reduced. Also, due to less assembly tolerance and deformation as compared to a cylindrical hinge boss, the cutting edge portions of each of first and second blades can be prevented from being warped.

FIG. 11 is an exploded view of the assembly structure of the razor according to a fourth embodiment of the present disclosure. Specifically, FIG. 11 shows a case where the elements of the razor according to an embodiment are vertically separated with a top cap removed.

Referring to FIG. 11, at least one first blade through hole 910 and at least one second blade through hole 930 are formed in the middle of first and second blades 91 and 93. At least one spacer through hole 920 is also formed at the spacer 92, disposed between the first and second blades 91 and 93, at a location corresponding to the second blade through hole 930 to vertically penetrate the spacer 92.

On the top surface of frame 90, at least one frame boss 900 may be formed at a location corresponding to the first blade through hole 910, the second blade through hole 930, and the spacer through hole 920. The frame boss 900 may protrude upward from the top surface of the frame 90.

The upwardly protruding frame boss 900 may be configured to pass through the through holes of the first blade 91, the spacer 92, and the second blade 93 when the first blade 91, the spacer 92, and the second blade 93 are sequentially assembled onto the frame 90. Thus, the above elements of the razor may be fixed by the frame boss 900 of the frame 90 and may be prevented from deviating sideways.

Thus in certain embodiments including a frame boss 90, maintaining alignment of the first blade second blade may be improved.

The example of FIG. 11 illustrates that pairs of coupling portions at both ends of the frame 90 and at both ends of the spacer 92 are snap-fit-coupled and hinge-coupled, but the structures of the considered embodiments are not particularly limited. For example, the coupling portions of FIG. 11 may be implemented as all possible combinations of the coupling portions that have been described above.

FIG. 12 is another example of a cross-sectional view showing a razor according to a fifth embodiment of the present invention, which includes two spacers and three blades, as viewed from a side of the razor.

Specifically, the razor according to the embodiment depicted in FIG. 12 includes three blades 50, 51, and 52. A double-edge blade, which has an original flat shape before being coupled, fixed, and supported by the elements of the razor may be used as the third blade 52, or a double-edge blade which already has a convex central portion may be used as the third blade 52. Thus, the double-edge blade used as the third blade 52 may be of the same type as double-edge blades used as the first and second blades 50 and 51, and the double-edge blades used as the first and second blades 50 and 51 may incorporate the first and second blades as described with respect to the embodiments discussed above.

The third blade 52 may be located above the second blade 51. Thus, the first, second, and third blades 50, 51, and 52 may be referred to sequentially in an upward direction from the frame 20 to the top cap 40. A second spacer 301 may be included between the second and third blades 51 and 52 to support the top of the second blade 51 and the bottom of the third blade 52. Accordingly, the spacer disposed between the first and second blades 50 and 51 may be referred to as a first spacer 300. The relationships between the frame 20, the first blade 50, the first spacer 300, and the second blade 51 may be similar to the embodiments as described above. Further in such embodiments, the second spacer 301 may perform the same or similar functions as the top cap 40 with respect to supporting the blades, and thus, a description thereof will be omitted.

In an embodiment, the bottom surface of the top cap 40 may be seated on the top surface of the third blade 52 which is seated on the top surface of the second spacer 301. Thus, in the depicted embodiment the third blade 52 is fixedly coupled to a razor 1 by being supported between the top surface of the second spacer 301 and the bottom surface of the top cap 40.

In some embodiments, the third blade 52 may be at least partially in contact with, and supported by, the bottom surface of the top cap 40 and the top surface of the second spacer 301, and as a result, the top surface of the second spacer 301 and the bottom surface of the top cap 40 may define a shape into which the third blade 52 is to be bent when the assembly of the razor is complete. The bent shape of the third blade 52 is referred to as a third profile 370. The bent shape of the third blade 52 may be determined by the bottom surface of the top cap 40 and the top surface of the second spacer 301.

The third profile 370 is determined by the second spacer 301 and the top cap 40 in a similar manner to that used to form first and second profiles 310 and 320 with the frame 20, the first spacer 300, and the second spacer 301. The third profile 370 may be configured to have different curvatures in the central region and the curvature regions thereof, thereby controlling the degree to which, and the angle at which, cutting edges project. The cutting edges of the third blade 52 may be disposed above groove portions 29.

In the embodiment of FIG. 12, three blades 50, 51, and 52 are included, but the number of blades that can be used at the same time by a razor is not particularly limited. That is, four or more blades may be used in some embodiments. It will be apparent to those of ordinary skill that the number of spacers that separate blades may vary depending on the number of blades used.

Some embodiments where a plurality of blades are inserted in a single razor 1 have been described above, but other embodiments that allow a user to insert a single blade at a desired location in a razor and to use the razor are possible. Also, in some embodiments, the user can arbitrarily insert only one blade or two blades at a desired location in a razor and use the razor, despite the razor being configured to accommodate additional blades. Thus, as the number of spacers provided in a razor changes, the number of blades may be one more than the number of spacers, but may be equal to or less than the number of spacers.

It will be understood by those skilled in the art that the present invention has been discussed with respect to the exemplary embodiments but that the present invention is not limited to these exemplary embodiments. It is therefore to be understood that the above-described embodiments are illustrative in all aspects and not restrictive. The scope of the present invention is defined by the appended claims, rather than the foregoing detailed description of exemplary embodiments, and therefore all changes and modifications that fall within metes and bounds of the claims, or equivalents of such metes and bounds are therefore intended to be embraced by the claims.

While the present invention has been described in connection with the above-mentioned preferred embodiments, it should also be noted that modifications can be made to the exemplary embodiments discussed above without deviating from the spirit and scope of the present invention, as will be understood by those skilled in the art. Thus, such modifications and variations are intended to be within the scope of the present invention as disclosed in the appended claims.

What is claimed is:

1. A razor comprising:

a handle;

a frame coupled to an end portion of the handle;

a spacer disposed above the frame;

a top cap mounted at a top of the spacer;

a first blade secured between the frame and the spacer and having cutting edges on opposing ends in a lateral direction;

a second blade secured between the spacer and the top cap and having cutting edges on opposing ends in the lateral direction;

a first portion disposed at the end portion of the handle;

a second portion disposed at a center of a bottom surface of the top cap and coupled to the first portion by passing through the second blade, the spacer, the first blade, the frame and at least a portion of the handle; and a third portion protruding from a center of a bottom of the frame so as to be able to be coupled to the handle in a longitudinal direction of the handle, wherein the frame includes guard bars disposed at opposing lateral ends of the frame to be adjacent to the cutting edges of the first blade, wherein the first blade is supported by at least a portion of a top surface of the frame and at least a portion of a bottom surface of the spacer such that a first profile of the first blade is convexly curved upward, wherein the second blade is supported by at least a portion of a top surface of the spacer and at least a portion of the bottom surface of the top cap such that a second profile of the second blade comprises a curved central region that is convexly curved upward and a pair of curved side regions that are concavely curved downward on opposite sides of the central region, wherein an inside of the third portion is configured to be coupled to an outer periphery of the handle in a snap-fit manner, and wherein the first portion is configured to pass through the third portion.

2. The razor of claim 1, wherein an angle formed by tangent lines at the cutting edges of the first blade is greater than an angle formed by tangent lines at inflection points of the curves between the curved central region and the pair of curved side regions of the second profile.

3. The razor of claim 1, wherein a curvature radius of the curved central region of the second profile is smaller than a curvature radius of the pair of curved side regions of the second profile.

4. The razor of claim 1, wherein the frame and the spacer are configured to secure the first blade at least at both ends of the first blade.

5. The razor of claim 1, wherein:

the spacer is configured to support at least part of the curved central region of the second blade, and the top cap is configured to support at least part of the pair of curved side regions of the second blade.

6. The razor of claim 1, wherein:

each of the first blade, the second blade, and the spacer is shaped to comprise at least one corresponding through hole; and the frame comprises a protruding boss configured to pass through the corresponding through holes of the first blade, the second blade, and the spacer to secure positions of the first blade, the second blade, and the spacer.

7. The razor of claim 1, wherein corresponding cutting edges of the first blade and cutting edges of the second blade are disposed at opposing openings between the top cap and the frame extending in a longitudinal direction of the frame.

8. The razor of claim 1, wherein the first and second blades are double-edge blades having a same size.

9. The razor of claim 8, wherein the first and second blades have an originally flat shape and are configured to be bent according to a configuration of the frame, spacer, and top cap.

10. A razor comprising:

a handle;

a razor head portion coupled to an end portion of the handle and comprising a plurality of blades mounted therein, the plurality of blades comprising at least three blades including a first blade, a second blade, and a third blade;

a frame coupled to the end portion of the handle;

a plurality of spacers disposed above the frame, the plurality of spacers comprising at least two spacers including a first spacer and a second spacer disposed above the first spacer;

a top cap mounted at a top of the second spacer;

a first portion disposed at the end portion of the handle;

a second portion disposed at a center of a bottom surface of the top cap and coupled to the first portion by passing through the plurality of blades, the plurality of spacers, the frame and at least a portion of the handle;

a third portion protruding from a center of a bottom of the frame so as to be able to be coupled to the handle in a longitudinal direction of the handle; and guard bars disposed at opposing lateral ends of the frame to be adjacent to cutting edges of the first blade, wherein the first blade is secured between the frame and the first spacer, wherein the second blade is secured between the first and second spacers, wherein the third blade is secured between the second spacer and the top cap, wherein:

the plurality of blades are double-edge blades comprising cutting edges on opposing ends in a lateral direction, the plurality of blades are bent according to a configuration of the razor head portion, each of the plurality of blades is curved such that the plurality of blades have different curvatures at central regions thereof, an inside of the third portion is configured to be coupled to an outer periphery of the handle in a snap-fit manner, and the first portion is configured to pass through the third portion.

11. The razor of claim 10, wherein a curvature radius of the central region of a first blade of the plurality of blades is smaller than a curvature radius of the central region of a second blade of the plurality of blades.

12. The razor of claim 10, wherein a profile of the second blade comprises a curved central region that is convexly curved upward and a pair of curved side regions that are concavely curved downward on opposite sides of the central region.

13. The razor of claim 12, wherein an angle formed by tangent lines at the cutting edges of the first blade is greater than an angle formed by tangent lines at inflection points of the curves between the curved central region and the pair of curved side regions of the profile.

14. The razor of claim 12, wherein a curvature radius of the curved central region of the profile is smaller than a curvature radius of the pair of curved side regions of the profile.

15. The razor of claim 10, wherein:

each of the plurality of blades and each of the plurality of spacers are shaped to comprise at least one corresponding through hole; and the frame comprises a protruding boss configured to pass through the corresponding through holes of the plurality of blades and the plurality of spacers to secure positions of the plurality of blades and the plurality of spacers.

* * * * *